US007360378B2

(12) United States Patent
Foshee

(10) Patent No.: US 7,360,378 B2
(45) Date of Patent: Apr. 22, 2008

(54) KNITTED FABRIC WITH DUAL LAYER CONSTRUCTION AND METHOD FOR MAKING

(75) Inventor: Joseph V. Foshee, Alexander City, AL (US)

(73) Assignee: Russell Corporation, Atlanta, GA (US)

( * ) Notice: Subject to any disclaimer, the term of this patent is extended or adjusted under 35 U.S.C. 154(b) by 226 days.

(21) Appl. No.: 11/108,334

(22) Filed: Apr. 18, 2005

(65) Prior Publication Data

US 2005/0282455 A1 Dec. 22, 2005

Related U.S. Application Data

(60) Provisional application No. 60/581,937, filed on Jun. 22, 2004.

(51) Int. Cl.
*D04B 1/22* (2006.01)

(52) U.S. Cl. ..... 66/196; 66/202

(58) Field of Classification Search ..... 66/202, 66/169 R, 193, 195, 197
See application file for complete search history.

(56) References Cited

U.S. PATENT DOCUMENTS 5,284,031 A * 2/1994 Stoll et al. ..... 66/64
5,312,667 A * 5/1994 Lumb et al. ..... 428/91
5,547,733 A * 8/1996 Rock et al. ..... 428/91
5,735,145 A * 4/1998 Pernick ..... 66/196
5,787,503 A * 8/1998 Murphy, III ..... 66/196
6,194,332 B1 * 2/2001 Rock et al. ..... 442/312
6,427,493 B1 * 8/2002 Kasdan et al. ..... 66/169 R

* cited by examiner

*Primary Examiner*—Danny Worrell

(57) ABSTRACT

A knitted dual-layer fabric is disclosed, including an outer water-absorbent layer and an inner wicking layer having permanent wicking properties. The inner layer acts to draw moisture toward the outer layer and the outer layer acts to disperse the moisture therethrough. Also disclosed is a method for constructing a knitted dual-layer fabric, which includes: providing first and second yarns; knitting, in a first loop position, a first loop from the first yarn and a second loop from the second yarn; advancing to a next loop position; and repeating the knitting step to produce a plurality of first loops and a plurality of second loops. The first loop is positioned substantially behind the second loop. The plurality of first loops forms a first fabric layer exhibiting characteristics of the first yarn. The plurality of second loops forms a second opposite fabric layer exhibiting characteristics of the second yarn.

12 Claims, 1 Drawing Sheet

KNITTED FABRIC WITH DUAL LAYER CONSTRUCTION AND METHOD FOR MAKING

CROSS REFERENCE TO RELATED APPLICATIONS

This application claims the benefit of U.S. Provisional Application No. 60/581,937, filed Jun. 22, 2004.

FIELD OF THE INVENTION

The present invention is generally related to a composite fabrics and, more particularly, is related to a dual-sided fabric with wicking properties.

BACKGROUND

Moisture control is an important consideration in designing athletic apparel. A person exercising produces sweat, and evaporation of the sweat keeps body temperature at an appropriate level. This process helps the person to stay cool in the summer and warm in the winter. However, if a person's athletic apparel absorbs the perspiration, it becomes wet and can hinder the evaporation process which is important to temperature control. Wet fabric sticks to the skin and can cause the wearer to become cold in cooler weather.

Many fabrics used in athletic apparel, such as cottons, nylons and polyesters, have this problem with absorbing moisture. To solve this problem, fabrics can be treated with a wicking finish. A wicking finish is a coating applied to the fabric which allows it to wick moisture away from the inside of the fabric, from next to the skin to the outside of the fabric, where the moisture can evaporate. Because the wet layer is not next to the skin after the moisture has been wicked away, the wearer is more comfortable and less likely to become cold. However, a fabric with a wicking finish may lose its wicking properties after repeated washing. Also, such finishes interfere with the dyeing process.

SUMMARY

An embodiment of a knitted dual-layer fabric in accordance with the invention includes an outer water-absorbent layer; and an inner wicking layer having permanent wicking properties. The inner layer acts to draw moisture toward the outer layer and the outer layer acts to disperse the moisture therethrough to the atmosphere.

An embodiment of a method for constructing a knitted dual-layer fabric in accordance with the invention includes the steps of: providing a first and a second yarn; knitting, in a first loop position, a first loop from the first yarn and a second loop from the second yarn; and advancing to a next loop position and repeating the knitting step to produce a plurality of first loops and a plurality of second loops. In the knitting step, the first loop is positioned substantially behind the second loop, such that the plurality of first loops forms a first fabric layer and the plurality of second loops forms a second fabric layer opposite the first. The first fabric layer exhibits characteristics of the first yarn. The second fabric layer exhibits characteristics of the second yarn.

Other features and/or advantages in addition to, or in lieu of, those presented above will be or may become apparent to one with skill in the art upon examination of the following drawings and detailed description. It is intended that all such additional features and/or advantages be included herein within the scope of the present invention.

DESCRIPTION OF THE DRAWINGS

The disclosed fabric can be better understood with reference to the following drawings. The elements of the drawings are not necessarily to scale, emphasis instead being placed upon clearly illustrating the principles of the fabric. Moreover, in the drawings, like reference numerals designate corresponding parts throughout the several views.

DETAILED DESCRIPTION

Figure 1:
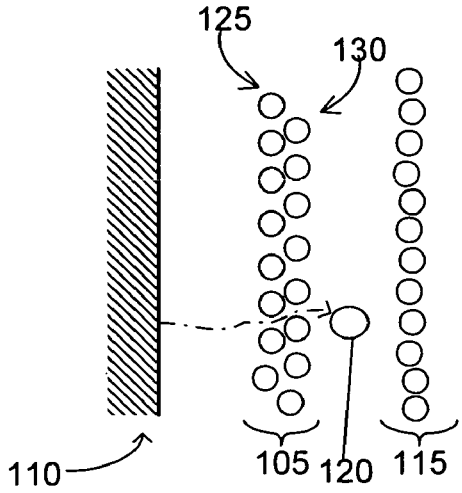
FIG. 1 is a fragmentary sectional view of the knitted fabric with dual-layer construction.

FIG. 1 illustrates an embodiment of the knitted fabric with dual-layer construction. Knitted fabric 100 comprises two layers. Inner layer 105 is worn closest to the skin 110. Outer layer 115 is adjacent inner layer 105. Inner layer 105 and outer layer 115 are also known as the "technical back" and "technical face" of the fabric, respectively.

Inner layer 105 has wicking properties, acting to wick moisture 120 from the side 125 closest to the skin to the side 130 closest to outer layer 115. Outer layer 115 has water-absorbent properties, such that moisture absorbed by outer layer 115 disperses readily throughout the layer. This dispersal leads to efficient evaporation.

Outer layer 115 (the technical face) is constructed using yarn 135. In one embodiment, yarn 135 comprises multiple yarns that are mechanically blended during the knitting process. In one blended embodiment, the blend is 85% combed cotton yarn and 15% polyester yarn. In another embodiment, yarn 135 is all cotton rather than a blend. Other water-absorbent yarns or blends may be used, such as rayon, wool, or a product sold under the registered trademark, Hydrofil®.

Inner layer 105 (the technical back) is constructed using yarn 140, which has permanent wicking properties. Specifically, the wicking properties of inner layer 105 are inherent in wicking fibers 145 which make up yarn 140. Wicking fibers 145 have capillaries which transport moisture through the fiber. Because the wicking properties are inherent in fibers 145, subsequent processing of inner layer 105 (e.g., dyeing, washing, softening, etc.) does not destroy its wicking properties. In one embodiment, fibers 145 are those sold under the registered trademark, Hydrotec® polyester yarn. Other embodiments of fiber 145 include those sold respectively, under the registered trademarks, CoolMax® and Aqwateck®. Other types of fibers may be used, as long as the resulting inner layer 105 has permanent wicking properties.

In the prior art, a wicking finish is applied to a fabric to give it wicking properties. However, this wicking finish is incompatible with various processes commonly used to treat fabric. In particular, a wicking finish interferes with the process of jet-dyeing. Use of wicking fibers 145 in inner layer 105 advantageously allows dual layer fabric 100 to be jet-dyed. The use of jet-dyeing rather than other dyeing processes is advantageous because different colors can be applied to inner layer 105 and to outer layer 115.

Inner layer 105 and outer layer 115 of dual-layer fabric 100 are formed concurrently by a knitting process. The knitting process interloops one or more ends of yarn to produce a fabric with intermeshed loops. Advantageously, a plaited knitting technique is used to construct dual-layer fabric 100. When plaiting is used, one yarn (135) always appears on the technical face and the other yarn (140) always appears on the technical back. This results in a dual-layer fabric where both layers are integrated and yet have distinct properties because of the two different yarns.

The dual-layer fabric is preferably between 16- and 20-gauge (stitches/inch), with a weight that ranges from about 9.0 oz./sq. yd. to about 11 oz./sq. yd. The overall fabric is a blend ranging from 55% cotton/45% polyester to 70% cotton/30% polyester.

In one embodiment, a third tie-in yarn is used to join the face yarn (135) and the back yarn (140). Use of this tie-in yarn in the plaiting process produces a dual-layer fabric known as three-end fleece. The tie-in yarn has water-absorbent properties also, and may be the same type of yarn, or blend of yarns, as the face yarn.

Having the structure as described above, dual-layer fabric 100 is suitable for athletic clothing, for example, sweatshirts, sweatpants, hats, socks, etc. The fabric functions in the following manner. Inner-layer 105 is worn close to the skin. Perspiration is transferred from the skin to wicking inner layer 105, by direct contact or by evaporation from the skin and then via condensation onto inner layer 105. The liquid spreads throughout inner layer 105 via the capillaries of wicking fibers 145. The moisture is then absorbed by outer layer 115, spreads readily throughout the layer, and evaporates from the outer surface of outer layer 115.

The feature of transporting moisture from inner layer 105 to outer layer 115 is partly due to the properties of yarns 135 and 140. The plaited construction of dual-layer fabric 100 further contributes to this moisture transport feature. Plaiting arranges the two different types of yarns in close proximity to each other, which results in a moisture concentration gradient between inner layer 105 and outer layer 115. This gradient further enhances the movement of moisture through the fabric. Finally, the interlocking nature of the two layers means that air flows easily between the layers, which avoids the need for a separate lining garment.

Figure 2:
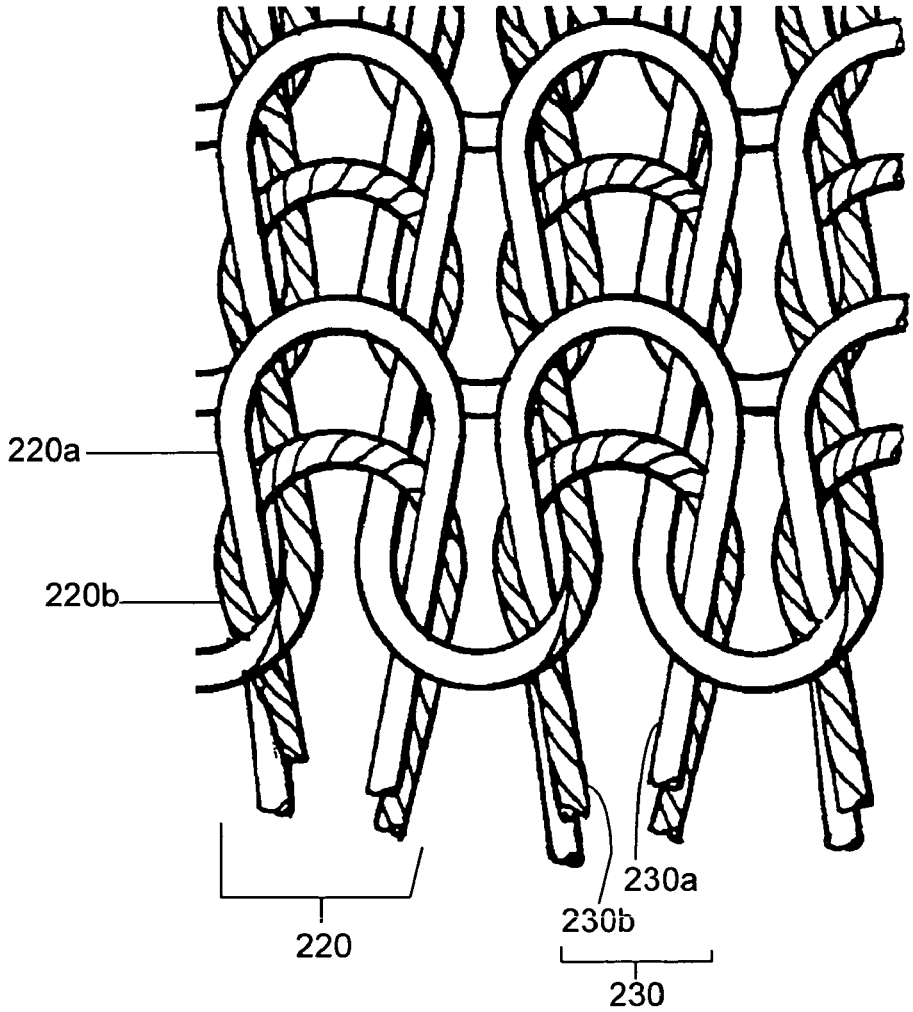
FIG. 2 is a fragmentary perspective view of the knitted fabric with dual-layer construction, illustrating how the two layers are formed during knitting.

A process for making the dual-layer fabric will now be described with reference to FIG. 2. Inner layer 105 and outer layer 115 are formed concurrently during the knitting process. The two layers are formed using a procedure called plaiting, whereby fabric 100 is knitted from two different yarns, 135 and 140. (The properties of yarns 135 and 140 were described earlier with reference to FIG. 1). While in loop position 220, yarn 135 is used to form a first loop 220*a* and yarn 140 is used to form a second loop 220*b*, with loops 220*a* and 220*b* positioned one behind the other. The loop position is advanced to the next loop position 230, where the process repeats to form loops 230*a* and 230*b*. When one row, or course, is finished, the process repeats at the next row.

The plaiting process results in a dual-layer fabric where both layers are integrated and yet have distinct properties because of the two different yarns. Because the loops are positioned behind each other during plaiting, loops 220*a* and 230*a* form one surface, or layer, and loops 220*b* and 230*b* form another surface, or layer. The characteristics of yarn 135 are visible on one layer, while the characteristics of yarn 145 are visible on the opposite layer. With reference to FIG. 1, loops 220*a* and 230*a* form outer layer 115, and 220*b* and 230*b* form inner layer 105. In one embodiment, yarn 135 is a mechanical blend of different types of yarns, for example, cotton and polyester. In this embodiment, some face loops are formed by needles using cotton yarn and other face loops are formed by needles using polyester yarn. Thus, the overall fabric face has some cotton and some polyester.

Once constructed, one or more finishing processes may be applied to dual-layer fabric 100. In one embodiment, dual-layer fabric 100 is dyed in a jet-dyeing machine. Jet-dyeing is a textile dyeing process that directs streams of liquid dye at a fabric. A length of fabric is circulated through a dye bath by a rapidly-moving jet of the liquid dye. The energy of the jet forces the dye deep into the fibers of the fabric. Jet dyeing allows the dye to be brought into contact with the fabric under selected temperature and pressure conditions.

The dye is a conventional dye, such as a direct dye, reactive dye, or sulfur dye. One skilled in the art will appreciate that the ratio between dye and fabric can be varied according to the dye characteristics and fabric characteristics.

Other finishing processes may be applied to dual-layer fabric 100, either before or after the jet-dyeing, as appropriate. In one embodiment, a napping process is used on inner layer 105 to raise the surface of the fibers. Napping gives inner layer 105 a fuzzy or soft texture. An additional fabric softening process may also be applied to dual-layer fabric.

The foregoing description has been presented for purposes of illustration and description. It is not intended to be exhaustive or to limit the invention to the precise forms disclosed.

Obvious modifications or variations are possible in light of the above teachings. The embodiments discussed, however, were chosen and described to illustrate the principles of the invention and its practical application to thereby enable one of ordinary skill in the art to utilize the invention in various embodiments and with various modifications as are suited to the particular use contemplated. All such modifications and variation are within the scope of the invention as determined by the appended claims when interpreted in accordance with the breadth to which they are fairly and legally entitled.

Therefore, having thus described the invention, at least the following is claimed:

1. A dual-layer knitted fabric for use in athletic garments, comprising:

an outer water-absorbent layer;

an inner wicking layer having permanent wicking properties; and a tie-in yarn joining the inner and outer layers, wherein the inner layer acts to draw moisture toward the outer layer and the outer layer acts to disperse the moisture therethrough, wherein the inner layer comprises a plurality of wicking fibers, each of the wicking fibers acting as a capillary to draw moisture therethrough.

2. The fabric of claim 1, wherein the outer layer comprises:

a first cotton yarn; and a second polyester yarn, wherein the first and second yarn are mechanically blended.

3. The fabric of claim 1, wherein the first and second yarn are mechanically blended to produce a resulting fabric of 55-70% cotton and 45-30% polyester.

4. The fabric of claim 1, wherein the inner layer is composed of a polyester yarn.

5. A composite fabric comprising:

an outer layer comprising a first plurality of fibers with water-absorbent properties; and an inner layer comprising a second plurality of fibers with permanent wicking propertiess; and a tie-in yarn joining the inner and outer layers, wherein the inner and outer layer are formed concurrently by knitting with a plaited construction to form interlocking inner and outer layers, wherein each of the second plurality of fibers is a wicking fiber acting as a capillary to draw moisture therethrough.

6. The fabric of claim 5, wherein the outer layer comprises:

a first cotton yarn; and a second polyester yarn, wherein the first and second yarn are mechanically blended.

7. The fabric of claim 6, wherein the first and second yarn are mechanically blended to produce a resulting fabric of 55-70% cotton and 45-30% polyester.

8. The fabric of claim 5, wherein the inner layer is composed of a polyester yarn.

9. A method for constructing a dual-layer knitted fabric for use in athletic garments, the method comprising the steps of:

providing a first yarn, the first yarn having water-absorbent properties;

providing a second yarn, the second yarn having permanent wicking properties; and knitting, in a first loop position, a first loop from the first yarn and a second loop from the second yarn, such that the first loop is positioned substantially behind the second loop;

advancing to a next loop position and repeating the knitting step to produce a plurality of first loops and a plurality of second loops; and joining the first yard and the second yarn with a third tie-in yarn, such that the plurality of first loops forms a first fabric layer exhibiting characteristics of the first yarn and the plurality of second loops forms a second fabric layer opposite the first exhibiting characteristics of the second yarn, where the second yarn comprises a plurality of wicking fibers, each of the wicking fibers acting as a capillary to draw moisture therethrough.

10. The method of claim 9, where the first yarn comprises polyester, and further comprising the steps of:

providing a cotton yarn; and knitting, in a second loop position, a third loop from the cotton yarn and a second loop from the second yarn, such that the third loop is positioned substantially behind the second loop; and advancing to a next loop position and repeating the knitting step to produce a plurality of third loops and a plurality of second loops, such that the plurality of first and third loops forms a first fabric layer exhibiting characteristics of the polyester and cotton yarns and the plurality of second loops forms an opposite second fabric layer exhibiting characteristics of the second yarn.

11. The method of claim 9, wherein the number of first and third loops are chosen to produce a resulting fabric of 55-70% cotton and 45-30% polyester.

12. The method of claim 9, where the second yarn is polyester.

* * * * *